US005279494A

United States Patent [19]

Kitajima et al.

[11] Patent Number: 5,279,494

[45] Date of Patent: Jan. 18, 1994

[54] SHEET FINISHER WITH STANDARD TYPE STAPLER

[75] Inventors: Tadayuki Kitajima, Yokohama; Tsutomu Katsumata, Hashima; Masaharu Nakamura, Aichi, all of Japan

[73] Assignees: Canon Kabushiki Kaisha, Tokyo; Omron Corporation, Kyoto, both of Japan

[21] Appl. No.: 940,734

[22] Filed: Sep. 8, 1992

Related U.S. Application Data

[63] Continuation of Ser. No. 702,385, May 20, 1991, abandoned.

[30] Foreign Application Priority Data

May 23, 1990 [JP] Japan ..... 2-132797

[51] Int. Cl.[5] ..... B42B 2/00; B42B 2/02

[52] U.S. Cl. ..... 270/53

[58] Field of Search ..... 270/37, 53, 58

[56] References Cited

U.S. PATENT DOCUMENTS

| | | | |
|---|---|---|---|
| 4,382,592 | 5/1983 | Harding et al. | 270/58 X |
| 4,687,191 | 8/1987 | Stemmle | 270/53 |
| 4,928,941 | 5/1990 | Uto | 270/53 |
| 5,029,831 | 7/1991 | Green | 270/53 |
| 5,100,119 | 3/1992 | Komada et al. | 270/53 |

FOREIGN PATENT DOCUMENTS

| | | | |
|---|---|---|---|
| 0028165 | 5/1981 | European Pat. Off. . | |
| 0198970 | 10/1986 | European Pat. Off. . | |
| 3304875 | 8/1984 | Fed. Rep. of Germany . | |
| 60-248564 | 12/1985 | Japan . | |
| 2-97493 | 12/1990 | Japan | 270/53 |

*Primary Examiner*—Edward K. Look
*Assistant Examiner*—John Ryznic
*Attorney, Agent, or Firm*—Fitzpatrick, Cella, Harper & Scinto

[57] ABSTRACT

A sheet finisher apparatus includes a supporting device for supporting a stack of sheets; a stapler; a moving mechanism for moving the stapler between a clinching position for clinching the sheets on the supporting device by the stapler and a retracted position away from the clinching position; a clinching mechanism for effecting the stapling action of the stapler at the clinching position; and a drive transmitting device for effecting by one driving source movement of the stapler by the moving mechanism and a clinching operation by the clinching mechanism.

35 Claims, 11 Drawing Sheets

SHEET FINISHER WITH STANDARD TYPE STAPLER

This application is a continuation of application Ser. No. 07/702,385 filed May. 20, 1991, now abandoned.

FIELD OF THE INVENTION AND RELATED ART

The present invention relates to a sheet finisher for clinching sheet materials discharged from an image forming apparatus such as a copying machine.

Some copying machines are equipped with a sheet finisher for automatically clinching the sheets into one or more sets of sheets, after the sheets receive images and are discharged from the main assembly of the copying apparatus. The stapler used for clinching the sheets in the sheet finisher is the one which has been developed exclusively for such use, and therefore, the stapler is expensive. In addition, plural driving sources are used to move the stapler between a clinching position and a non-clinching position and to effect the stapling action. This also results in a cost increase. The structure for the stapling action also requires large space in the sheet finisher with the result of increased bulkiness of the sheet finisher.

SUMMARY OF THE INVENTION

Accordingly, it is a principal object of the present invention to provide a less expensive and small size sheet finisher.

According to an aspect of the present invention, there is provided a sheet finisher apparatus, comprising: supporting means for supporting a stack of sheets; a stapler for stapling the stack of the sheets; a moving mechanism for moving said stapler between a clinching position for stapling the sheets on said supporting means by said stapler and a retracted position away from the clinching position; a clinching mechanism for effecting the stapling action of said stapler at the clinching position; and drive transmitting means for effecting, by a single driving source, movement of said stapler by said moving mechanism and a clinching operation by said clinching mechanism.

According to another aspect of the present invention, there is provided a sheet finisher wherein said moving mechanism includes a swingable lever for moving said stapler between the clinching position and the retracted position, wherein said clinching mechanism includes a clinching lever for urging said stapler in a clinching direction by a swinging movement of the swingable lever, and wherein said drive transmitting means includes a driving shaft for transmitting the rotational driving force from the driving source, a first cam connected with the driving shaft to swing the swingable lever and a second cam connected with the driving shaft to swing the clinching lever.

According to these aspects of the present invention, one driving source is used to move the stapler between the clinching position and the nonclinching position and to effect the stapling operation, and therefore, the sheet finisher is less expensive, and in addition, the space required for the driving source means is reduced. Accordingly, the size of the sheet finisher is reduced.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
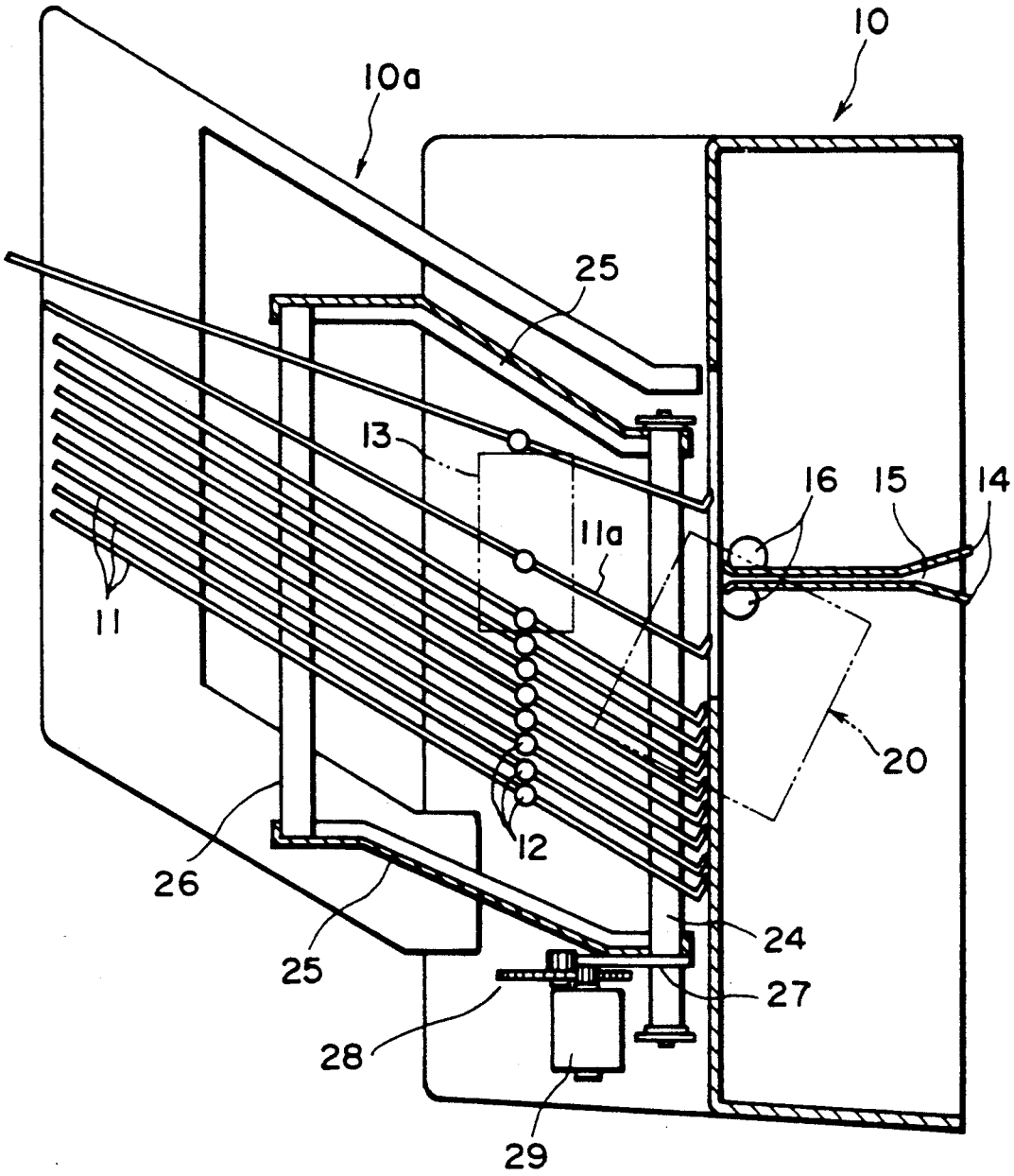
FIG. 1 is a front sectional view of a sheet finisher according to an embodiment of the present invention.
Figure 2:
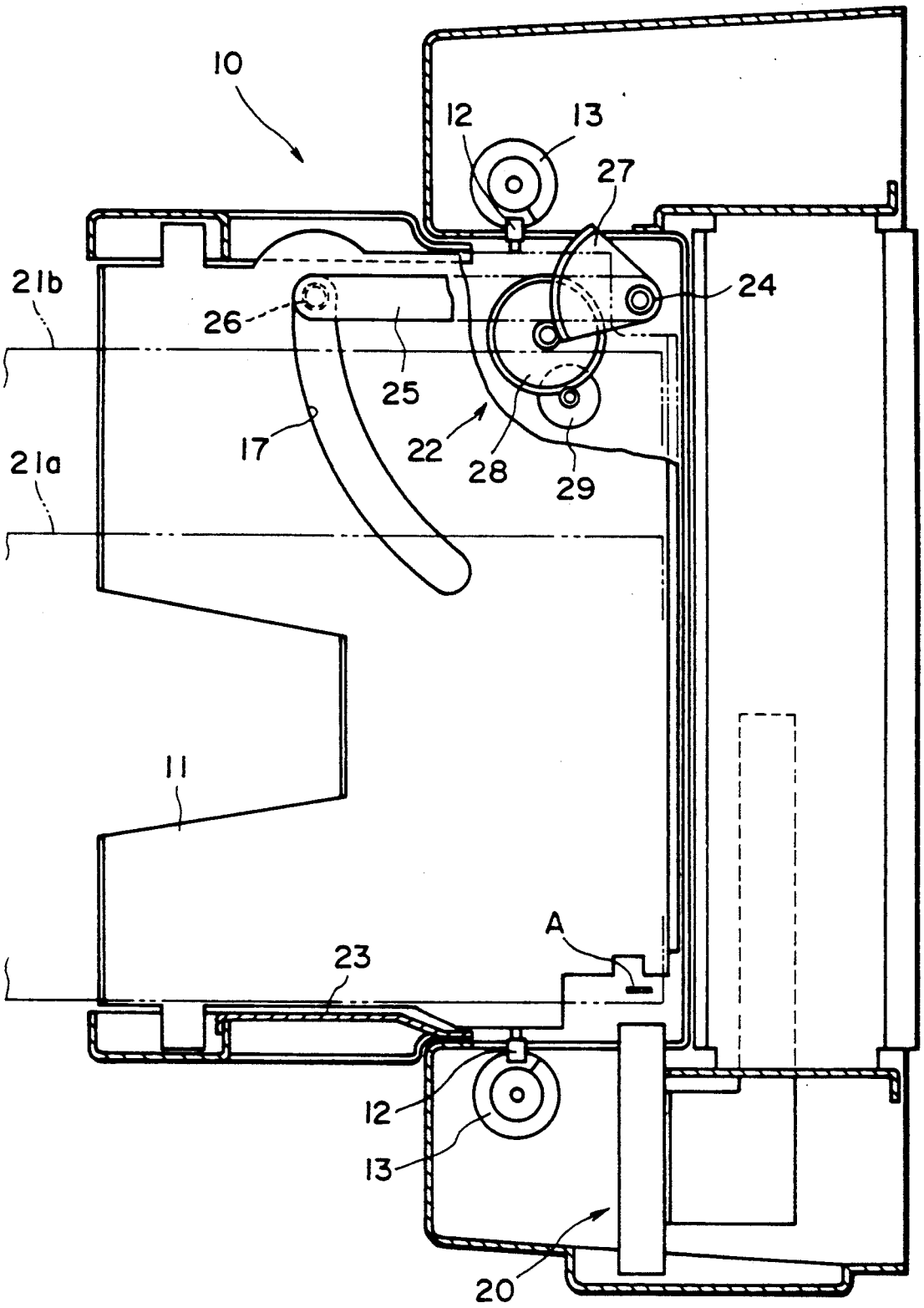
FIG. 2 is a top sectional view of the sheet finisher.

Referring to FIGS. 1 and 2, a sheet finisher 10 is in the form of a sorter provided with an automatic stapler and is coupled with a copying machine. The sorter 10*a* has ten sheet discharge trays 11 which are vertically stacked. Each of the trays 11 has pins 12 and 12 at its lateral sides. The pins 12 and 12 are engaged with a helical grooves formed in a circumferential surface of each of elevating rotatable members 13 and 13. By one full-rotation of each of the elevating rotatable members 13 and 13, the trays 11 are elevated or lowered one by one.

A sheet is subjected to a copying operation by a copying machine (not shown) and is discharged through a discharge passage 15, provided by top and bottom guide plates 14 and 14, to one of trays 11 by the top and bottom discharging rollers 16 and 16.

The structure of the sorter 10*a* may be any of known structure, and therefore, the detailed description thereof is omitted.

The automatic stapler 20 in the sorter 10*a* clinches the sheets 21*a*, 21*b* on the tray 11*a* supported by the elevating rotatable members 13 and 13.

Corresponding to the inclination of the sheet discharge tray 11*a*, the automatic stapler 20 is also inclined (FIG. 1).

As shown in FIG. 2, the automatic stapler 20 is disposed adjacent a lateral side at a front part of the tray 11. The non-stapling position thereof is determined so as not to obstruct the sheet discharge. Upon the clinching or stapling operation, the stapler 20 is moved to its clinching position A for clinching the sheets 21*a* and 21*b*.

Adjacent the opposite lateral side from the automatic stapler 20, there is provided a lateral aligning mechanism 22 for the sheets 21*a* and 21*b*. The lateral shifting mechanism 22 is adapted for a plurality of sizes of the sheets and is effective to urge the sheets 21*a* and 21*b* to a reference wall 23 so as to align the sheets 21*a* and 21*b* to a clinching position A.

The lateral shifting or aligning mechanism 22 has the following structure. It comprises a rotatable shaft 24 which is rotatably supported at the top and bottom ends. Adjacent the top and bottom ends, swingable arms 25 and 25 are fixed to the rotatable shaft 24. Between the other ends of the swingable arms 25 and 25, a lateral shifting bar 26 is extended.

Each of the trays 11 has an arcuate opening 17 for permitting swinging movement of the lateral shifting bar 26. The lateral shifting bar 26 has a vertical length sufficient to be actable on the sheets on all of the trays 11.

To the bottom end of the rotatable shaft 24, a sector gear 27 is fixed. The sector gear 27 is operatively connected with a reversible motor 29 through a reduction gear 28. By controlling the direction of rotation of the reversible motor 29, the lateral shifting lever 26 swings toward the center of the tray 11 to urge the sheets 21*a* and 21*b* to the reference wall 23, thus aligning the sheets 21*a* and 21*b*.

Normally, the lateral shifting mechanism 22 is operated in synchronism with the operation of the automatic stapler 20, as will be described hereinbefore. However, it is operable during the sheet discharging to effect the aligning operation simultaneously with the sheet discharging.

The structure of the above-described automatic stapler 20 will be described.

Figure 3:
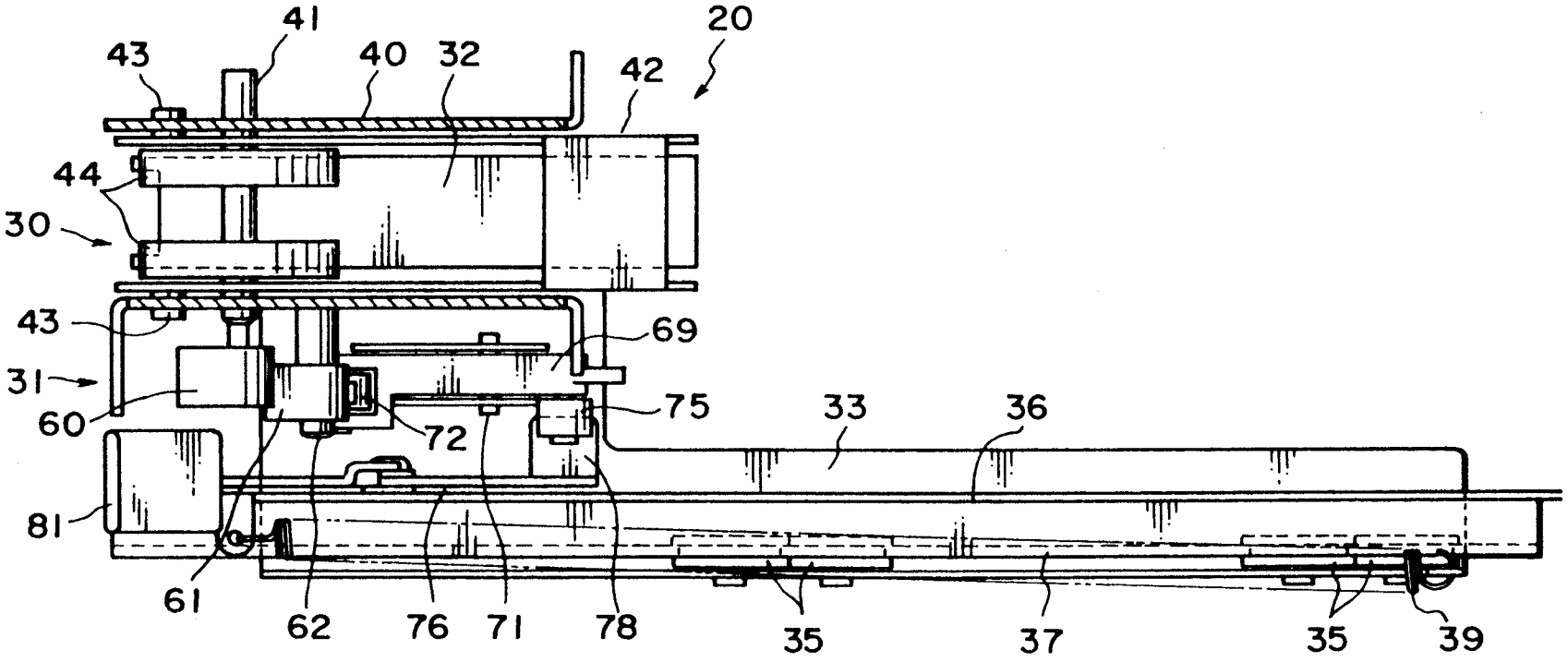
FIG. 3 is a top sectional view of an automatic stapler.
Figure 4:
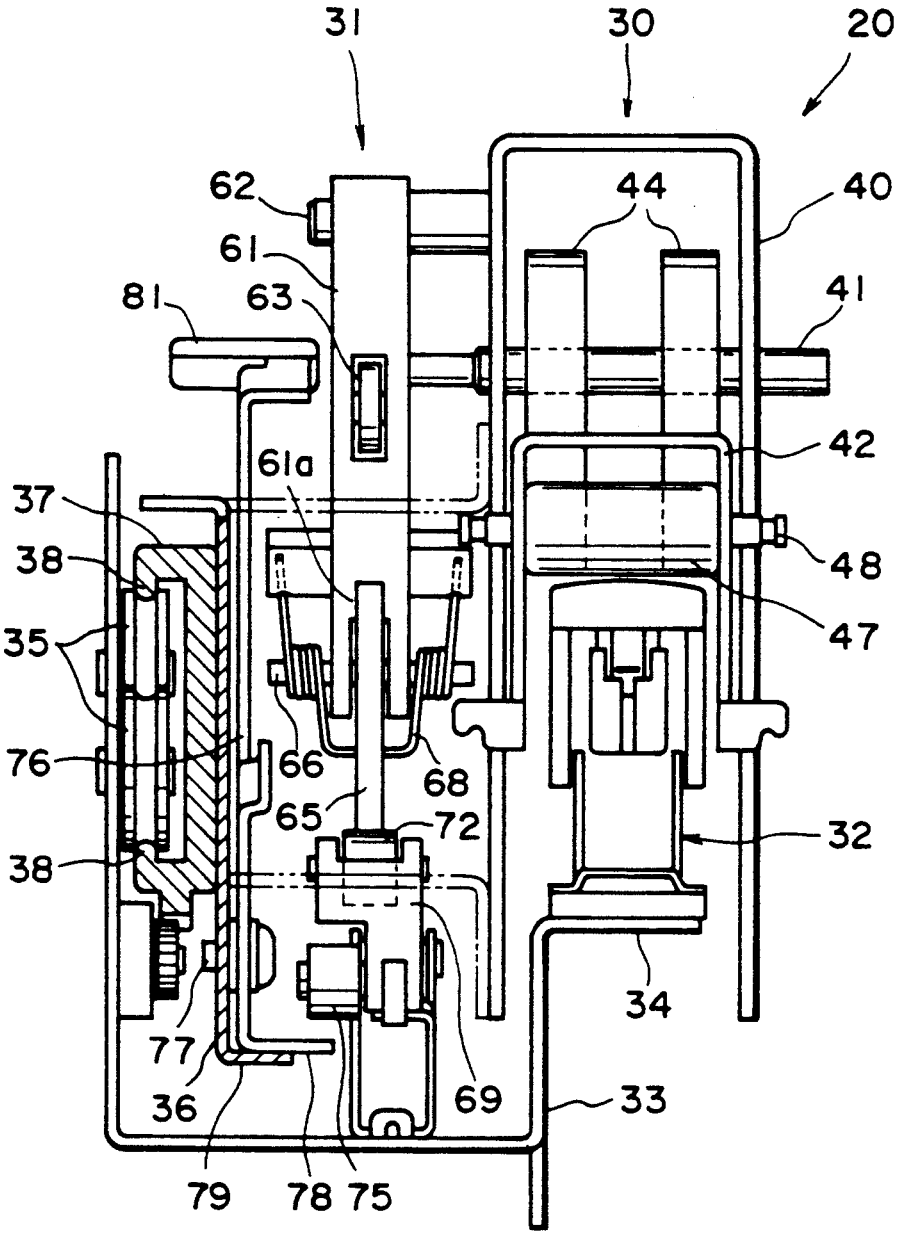
FIG. 4 is a back sectional view of the automatic stapler.

Referring to FIGS. 3 and 4, the automatic stapler 20 has a clinching mechanism 30 and a moving mechanism 31 which are juxtaposed with each other. A slidable frame 33 carrying the stapler 32 bridges between the mechanisms 30 and 31.

The stapler 32 comprises a clincher 32*a*, a magazine 32*b* for accommodating staples and an anvil 32*c*. The clincher 32*a* is urged by an unshown spring to return to a position which is a predetermined distance away from the anvil 32*c*. The stapler 32 is the one sold in a usual market as office equipment.

Figure 6:
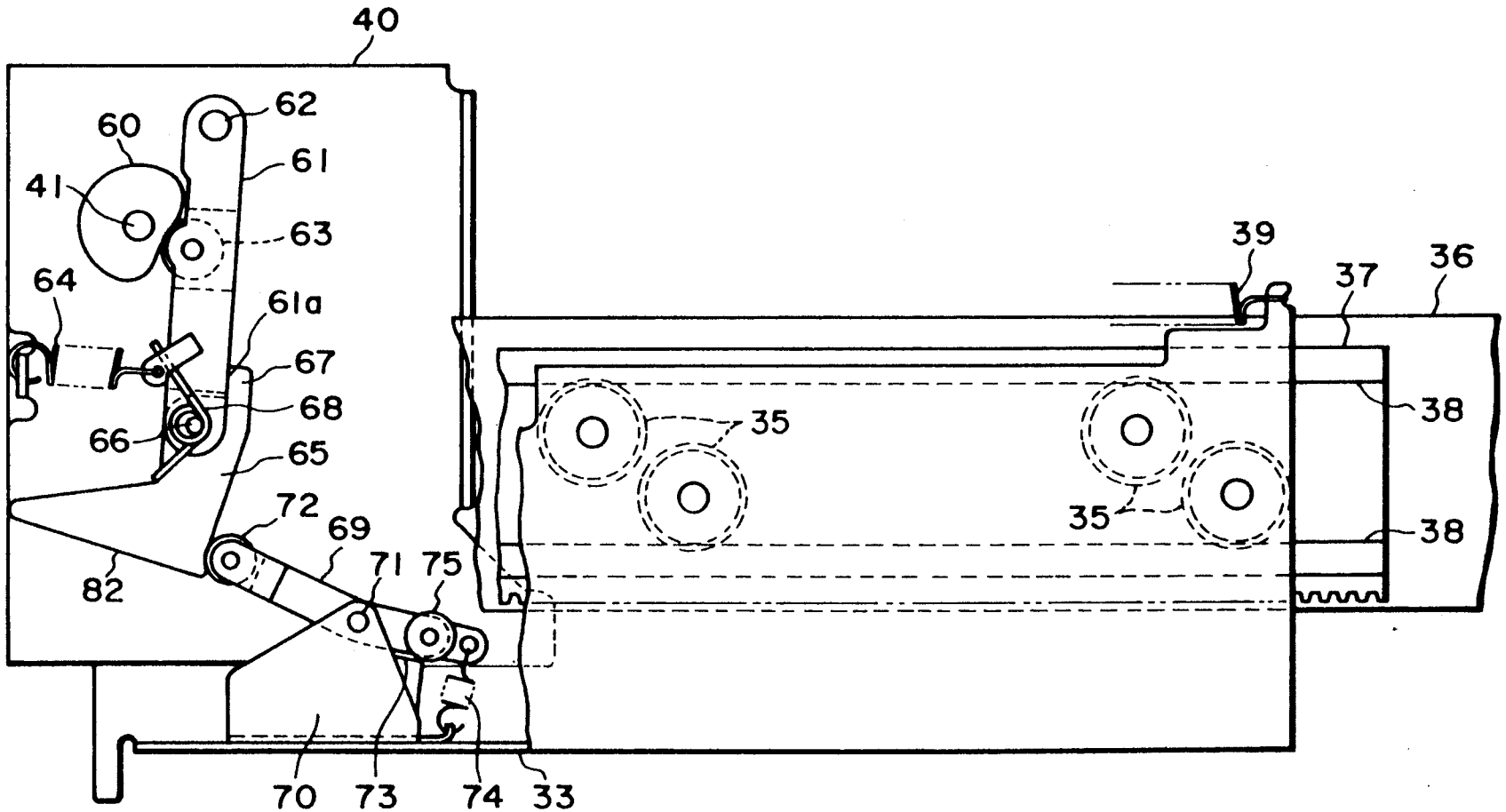
FIG. 6 is a side sectional view of a moving mechanism.

The slidable frame 33 is small in size in a top plan view at the clinching mechanism side and is large in the moving mechanism side (FIG. 3). It has a U-shaped cross-section (FIG. 4). In a back side view, the side thereof adjacent the clinching mechanism 30 is low and horizontal. It has a stapler supporting portion 34 as a bent portion. The moving mechanism side thereof is at a high level and is provided with four guiding rollers 35 at the inside (FIG. 6).

Figure 5:
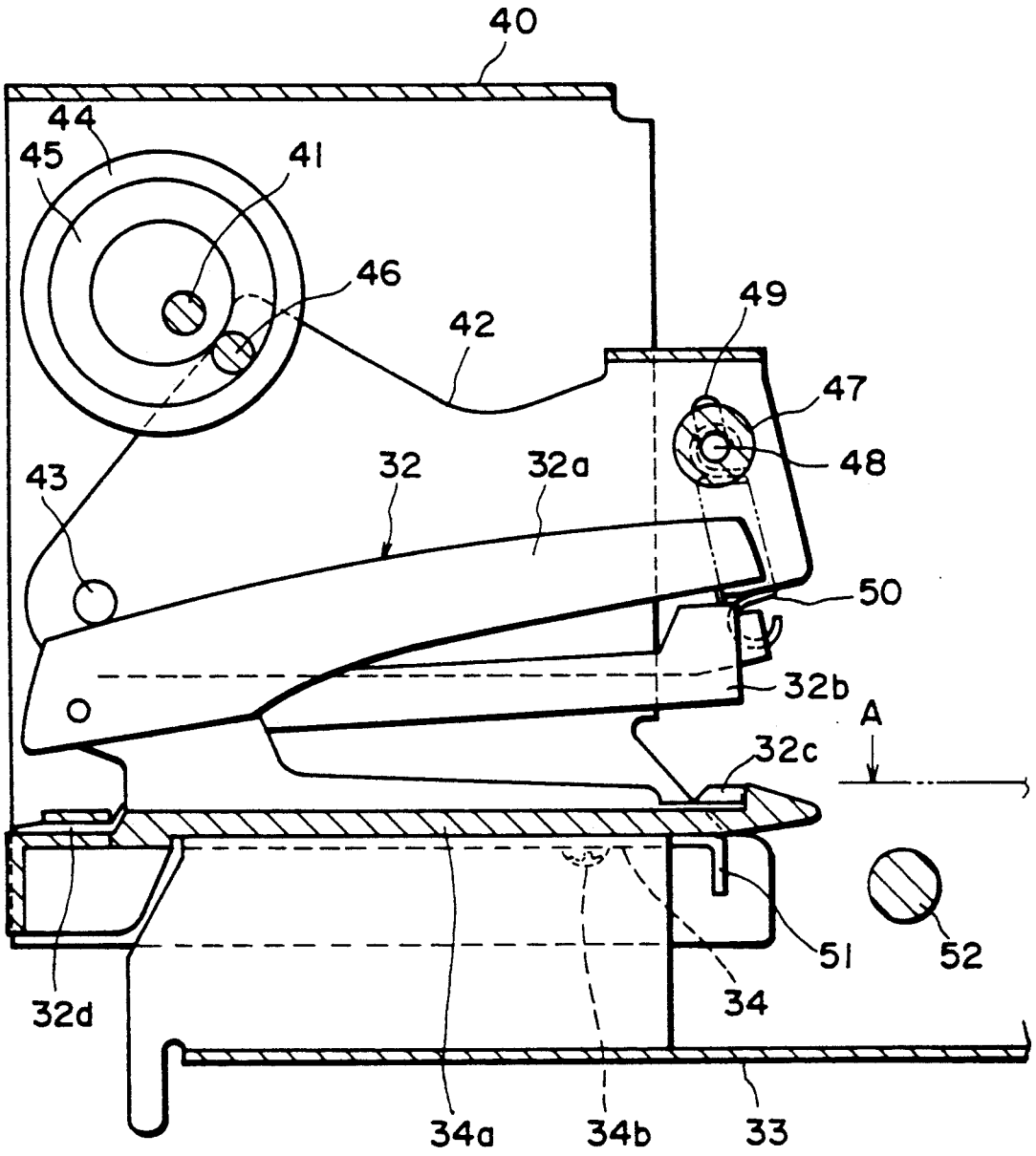
FIG. 5 is a side sectional view of a clinching mechanism.

The stapler 32 is the one readily available in the market. A rear end 32*d* of the stapler 32 is engaged with a mounting portion 34*a* of the mounting portion 34, as shown in FIG. 5. The front side of the stapler 32 is fixed on the mounting portion 34 by a screw 34*b*. Therefore, the staple 32 is detachably mounted by the screw 34*b*.

The guide rollers 35 are engaged to upper and lower surfaces 38 and 38 of a channel like rail 37 fixed on a fixed frame 36 mounted on the sorter 10*a*. Thus, the slidable frame 33 is guided between the non-clinching position to the clinching position A and between the clinching portion A and an outside staple loading position. A spring 39 is stretched between the fixed frame 36 and a slidable frame 33 to urge the slidable frame 33 to the loading position.

The moving mechanism 31 is effective to move the slidable frame from the non-clinching position to the clinching position A, and the spring 39 moves the moving mechanism 31 from the non-stapling position to the loading position by releasing the moving mechanism 31 therefrom.

The structure of the clinching mechanism 30 will be described.

Referring to FIGS. 3, 4 and 5, at an upper portion of a reverse U-shaped frame 40 fixed on the sorter 10*a*, a driving shaft 41 is rotatably supported and is extended out to the moving mechanism 31. The driving shaft 41 rotates through one full rotation by a motor through an unshown reduction gears.

Below the driving shaft 41, a clinching lever 42 is disposed which has a reverse U-shape at its front side, and is rotatably supported on the fixed frame 40 by a pin 43 at its rear or base side.

To the driving shaft 41, a pair of eccentric cams 44 are fixed so as to be operatively contactable to the clinching lever 42. The outside surface of the rotatable cam 44 has a cam groove 45 with which a pin 46 planted in the clinching lever 42 is engaged (FIG. 5).

With this structure, when the rotatable cam 44 rotates one full turn, the pin 46 is moved along the cam groove 45, so that the free end of the clinching lever 42 makes one reciprocation in the vertical direction.

Adjacent the free end of the clinching lever 42, a clinching roller 47 is mounted. The clinching roller 47 has a shaft 48 engaged with elongated slots 49 to permit vertical displacement of the roller 47. The shaft is urged down by a strong spring 50. Therefore, when the clinching lever 42 is urged by extremely large pressure, the clinching roller 47 retracts against the spring 50, thus avoiding application of extreme pressure.

The front end of the mounting portion 34 for the stapler 32 is formed into a tongue 31 which abuts a stopper 52 fixed on the fixed frame 36 when the stapler 32 moves to the clinching position A, so that the stapler 32 is correctly positioned at the clinching position A.

The structure of the moving mechanism 31 will be described.

Referring to FIGS. 3, 4 and 6, a generally heart mark shaped cam 60 is fixed to an end of the driving shaft 41. In the neighborhood of the rotatable cam 60, the upper end portion of the swingable lever 61 is swingably supported on the fixed frame 40 by a pin 62.

A roller 63 is rotatably supported on the swingable lever 61, and the roller 63 is contactable to the rotatable cam 60. A spring 64 is engaged at one end to the fixed frame 40 and is engaged at the other end with the swingable lever 61, so that the swingable lever 61 is normally urged to the rotatable cam 60 so as to establish a normal press-contact between the roller 63 and the rotatable cam 60.

Therefore, when the rotatable cam 60 is rotated one-full turn, the swingable lever 61 makes one reciprocation.

The bottom portion of the swingable lever 61 has an urging member 65 rotatably supported by a pin 66. The urging member 65 has an abutment part 67 at its upper front side so as to be contactable to the front surface 61*a* of the swingable lever 61 to urge it by a spring 68.

The urging member 65 rotates against the spring 68 when the slidable frame 33 is extremely urged in the sliding direction.

At the top surface of the bottom portion of the slidable frame 33, there is a contacting lever 69 at such a position as to face the above-described urging member 65. The middle portion of the contacting lever 69 is rotatably supported by a pin 71 on a supporting member 70 fixed on the top surface of the bottom portion of the slidable frame 33. On the rear portion thereof, a roller 72 contactable to the urging member 65 is rotatably supported. The bottom surface at the front side thereof is contacted to the stopper 73 extended from the supporting member 70, so that the position of contact between the roller 72 and the urging member 65 is limited, wherein the spring 74 provides the urging force.

Therefore, when the swingable lever 61 swings toward the front, the urging member 65 urges the contacting lever 69, so that the slidable frame 33 moves to the clinching position A. When the swingable lever 61 moves toward the rear, the spring 39 urging the slidable frame 33 retracts the swingable frame 33 to the retracted position.

Therefore, when the swingable lever 61 makes one reciprocation in response to one rotation of the rotatable cam 60, the slidable frame 33 makes one reciprocation movement.

When the roller 72 of the contacting lever 69 is disengaged from the urging member 65, the sliding frame 33 is permitted to move to the staple loading position.

The sliding movement is effected by the urging force of the spring 39. In order to carry out the above described disengagement, the contacting lever 69 has a rotatably mounted releasing roller 75. The roller 75 is operated by the releasing lever 76.

Figure 7:
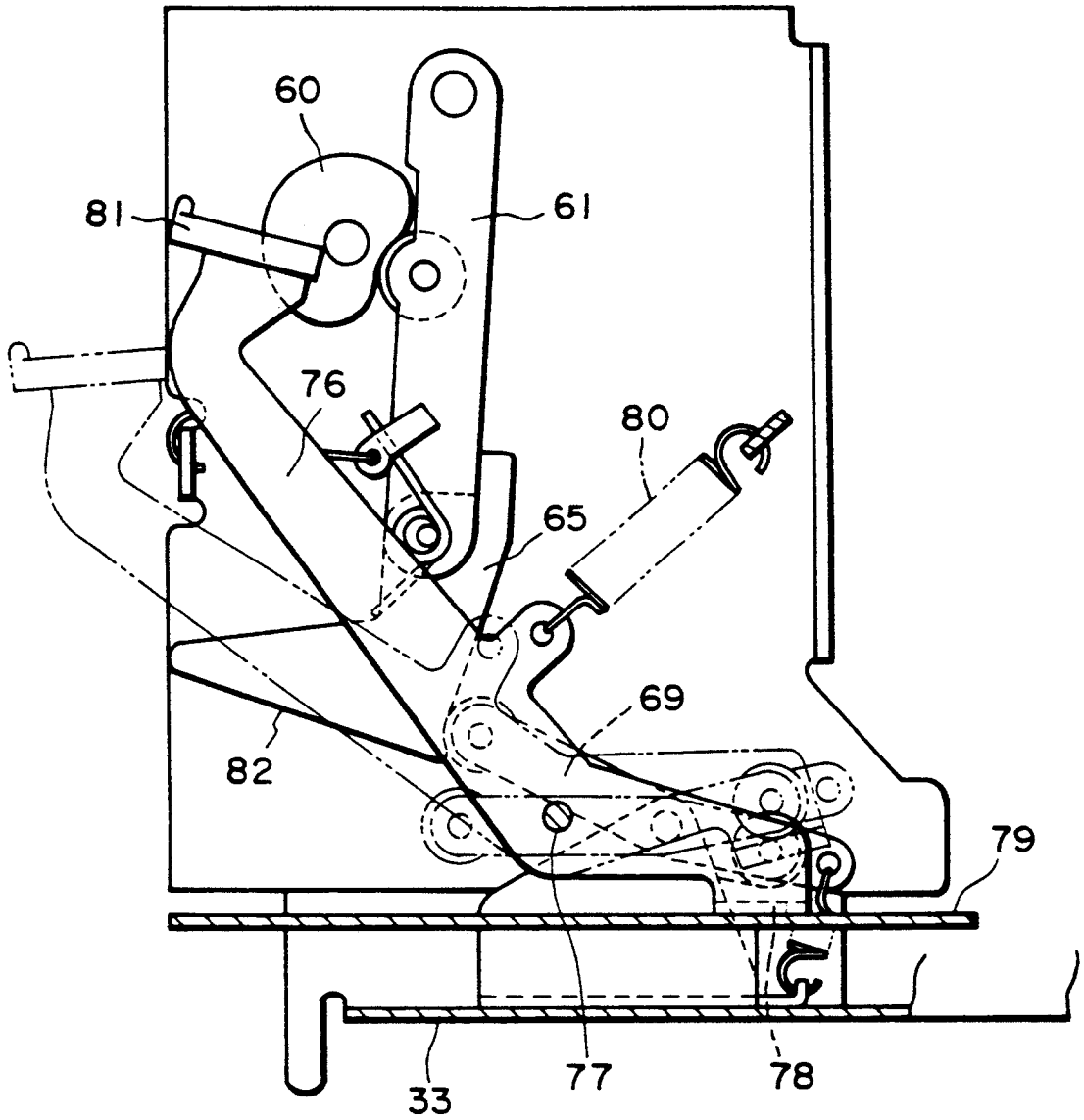
FIG. 7 is a side sectional view of a releasing lever.

As shown in FIG. 7, the bent portion of the releasing lever 76 is rotatably mounted on the fixed frame 36 by a pin 77, and the bottom portion is bent into a contactable part 78. The contactable part 78 is contactable to a bent portion 79 of the fixed frame 36. It is urged by a spring 80 having an end fixed to the fixed frame 36. The upper part of the releasing lever 76 has an operating part 81.

When the operating portion 81 of the releasing lever 76 is pressed down, the bottom contacting part 78 is raised into contact to a releasing roller 75 of the contacting lever 69, and by the rising of the roller 75, the rear roller 72 is disengaged from the urging part 65.

When the contacting lever 69 is returned to engagement with the urging member 65, the roller 72 of the contacting lever 69 is pressed down by an inclined guiding surface 82 of the urging member 65 to permit the returning, at the time when the slidable frame 33 is urged.

Figure 11:
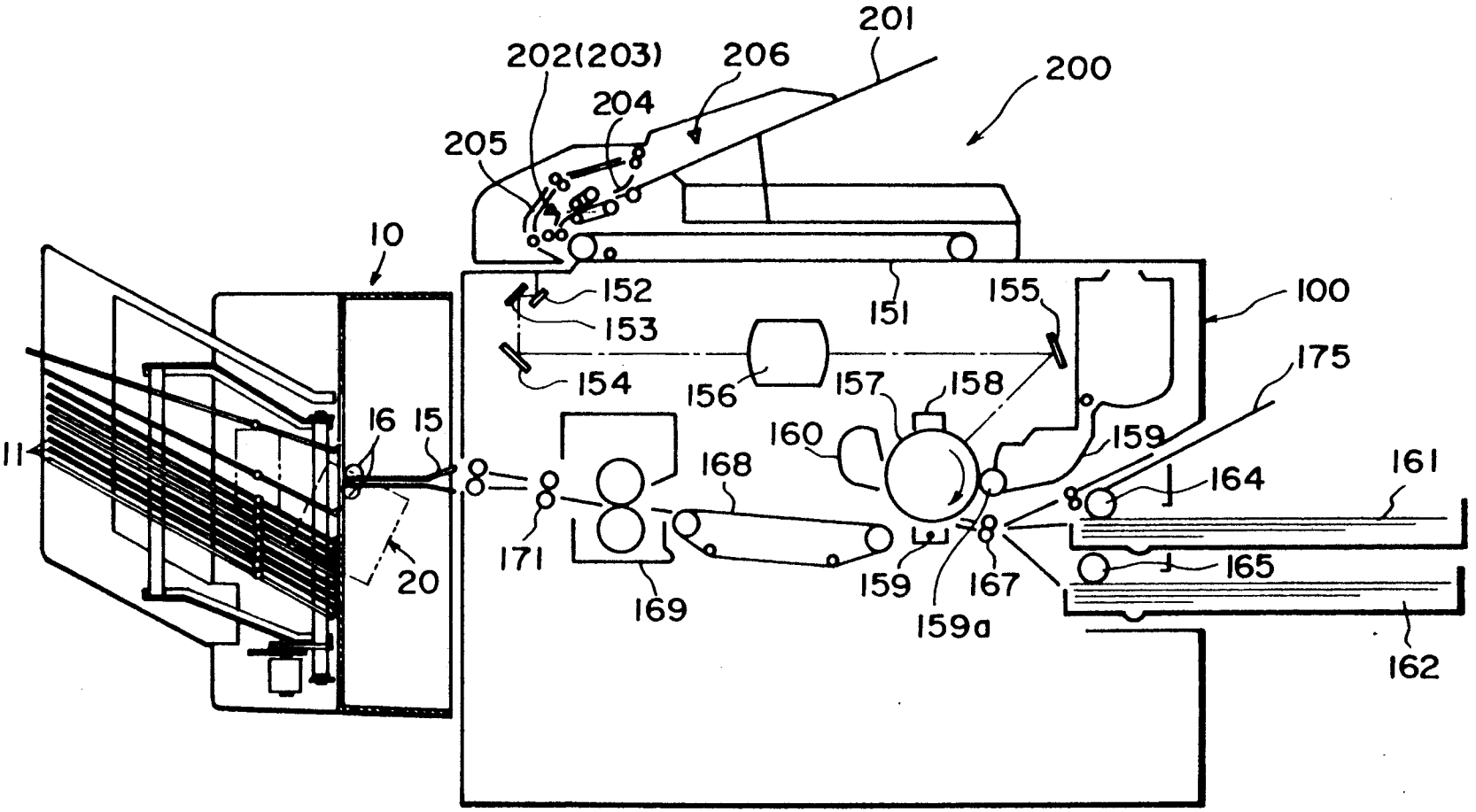
FIG. 11 is a front sectional view of a copying apparatus equipped with the sheet finisher shown in FIG. 1.

Referring to FIG. 11, an example of a copying machine equipped with the sheet finisher 10 described in the foregoing, will be described.

The copying machine 100 comprises an original supporting platen glass 151, scanning mirrors 152, 153, 154 and 155 for folding the optical path for the light reflected by the original, and a variable focus lens 156. It further comprises a photosensitive drum 157, a high voltage unit 158, a developing device 159, an image transfer charger 159 and a cleaning device 160.

The copying machine 100 is provided with an upper cassette 161, a bottom cassette 162, sheet feeding rollers 164, 165 and 166 and a registration roller 167. The sheet on which an image has been formed is conveyed to a fixing device 169 along a conveyor belt 168 with the aid of a conveying roller 171 and a sheet sensor 171*a*. The sheet may be manually fed from a manual tray 175.

The photosensitive drum 157 rotates in the direction of an arrow in response to depression of a copy start key which will be described hereinafter. Then, the drum 157 is rotated for a predetermined period of time, and the electric potential thereof is controlled. An original is illuminated by an illumination lamp not shown, and the light reflected from the original is imaged on the photosensitive drum 157 by way of the scanning mirrors 152, 153, 154 and 155 and the lens 156.

The photosensitive drum 157 has been charged by a corona charger supplied with the electric voltage from the high voltage source 158. The charged surface of the drum 157 is exposed to the light image of the original through the mirrors and lenses and through a slit, so that an electrostatic latent image is formed on the photosensitive drum 157.

The electrostatic latent image is developed by a developing roller 159*a* of the developing device on the photosensitive drum 157 into a toner image. The toner image is transferred onto a transfer sheet by the transfer charger 159.

The sheets in the upper cassette 161, the lower cassette 162 and the sheet deck 163 are fed out by the sheet feeding rollers 164, 165 and 166, respectively. The sheet fed out of one of them is once stopped by the registration roller 167, so that a loop of the sheet is formed. The registration roller 167 starts to feed the sheet at such a timing that a leading edge of the toner image formed on the rotating photosensitive drum 157 is aligned with the leading edge of the sheet. By the passage of the sheet between the photosensitive drum 157 and the transfer charger 159, the toner image is transferred from the photosensitive drum 157 onto the transfer sheet. After the completion of the image transfer, the sheet is separated from the photosensitive drum 157, and is conveyed on the conveying belt 168 to the fixing device 169, where the toner image is fixed thereon by heat and pressure. Then, the sheet is discharged from the apparatus by the feeding rollers 171.

The photosensitive drum 157 after the image transfer continues its rotation, so that the surface thereof is cleaned by the cleaning device 160.

The copying apparatus is equipped with an automatic original feeder 200, which comprises a stacking tray 201 for stacking the originals, sensors 202 and 203 for detecting the size of the original. The sensors are spaced from each other by a predetermined distance in a direction perpendicular to the sheet of drawing. The lateral dimension of the original is determined on the basis of whether both of the sensors 202 and 203 detect the original or whether only one 203 of the sensors detects the original, the sensor 203 is at the rear side.

If the number of sensors is increased, a larger number of lateral sizes can be detected. The longitudinal dimension of the original is discriminated on the basis of time duration in which the sensor 202 or 203 detects the original (the time period required for the original passage).

The original fed from the stacking tray 201 to the original supporting platen 151 along the sheet path 204 is stacked again on the tray 201 through the sheet passage 205.

The description will now be made as to the clinching operation of the automatic stapler 20. When the copying machine is discharging the copy sheets 21*a*, 21*b* onto the discharge trays 11, the automatic stapler 21 is disposed at the retracted position where the stapler 20 does not obstruct the sheet discharging action.

In the retracted state, the clinching mechanism 30 and the moving mechanism 31 are also at the retracted positions, shown in FIGS. 3, 5 and 6.

After the completion of a predetermined amount of copying operations by the copying machine, and when the automatic stapling mode is selected, the lateral shifting mechanism 22 operates at the initial stage of the operation in that mode to align all of the sheets 21*a* and 21*b* on all of the trays 11 to the clinching position A side (FIG. 2). In the case where the manual mode is selected, a manual switch is depressed after the completion of the copying operation, in response to which the above operation is started.

In this operation, by rotating the reversible motor 29 in the forward and backward directions through predetermined amounts, the lateral shifting or aligning bar 26 makes one reciprocation, by which the sheets 21*a* and 21*b* on all of the trays 11 are aligned to the reference wall 23 adjacent the clinching position A so that the sheets 21*a* and 21*b* are aligned to the clinching position.

Figure 8:
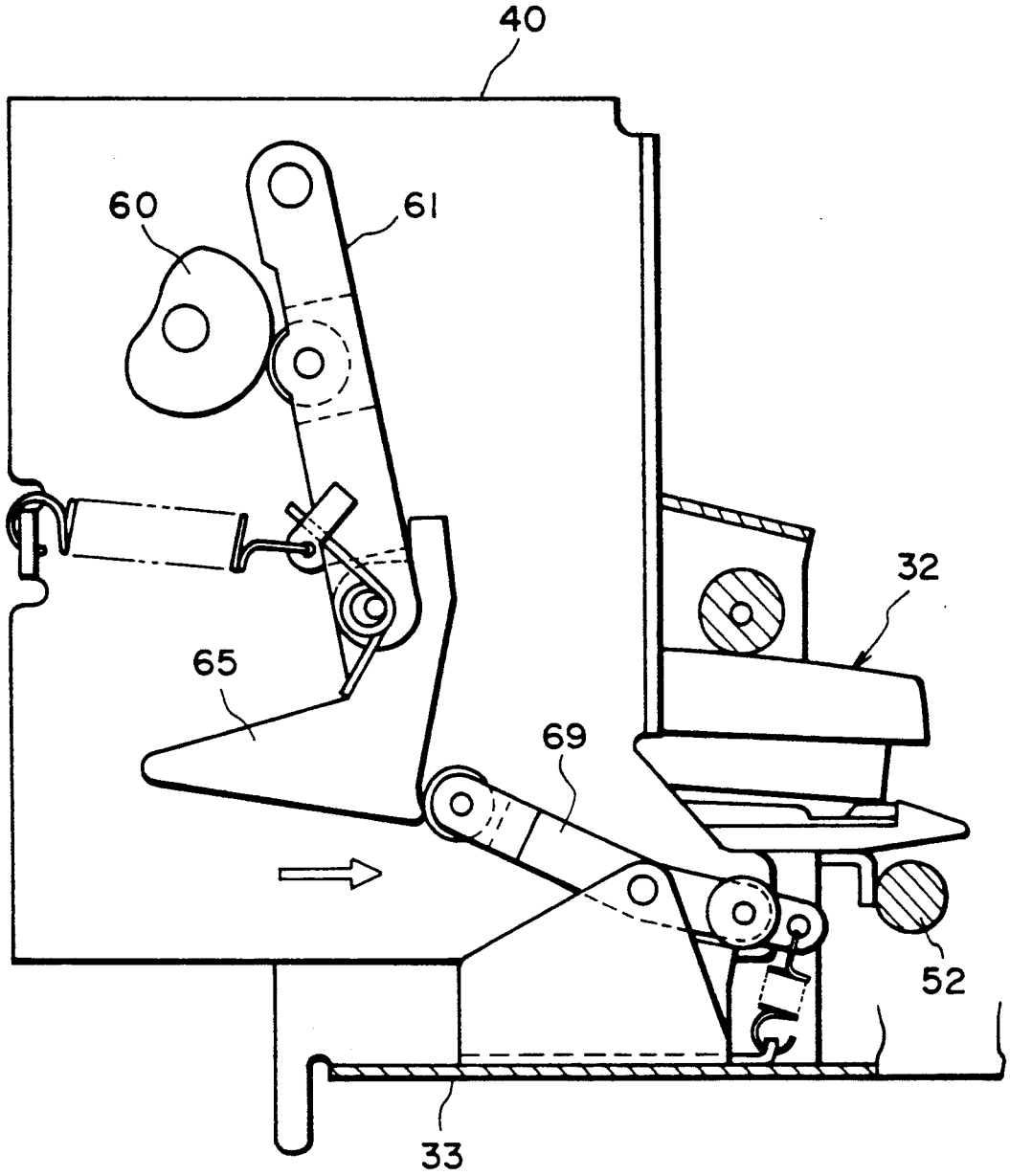
FIG. 8 is a side sectional view illustrating operation of the moving mechanism.
Figure 9:
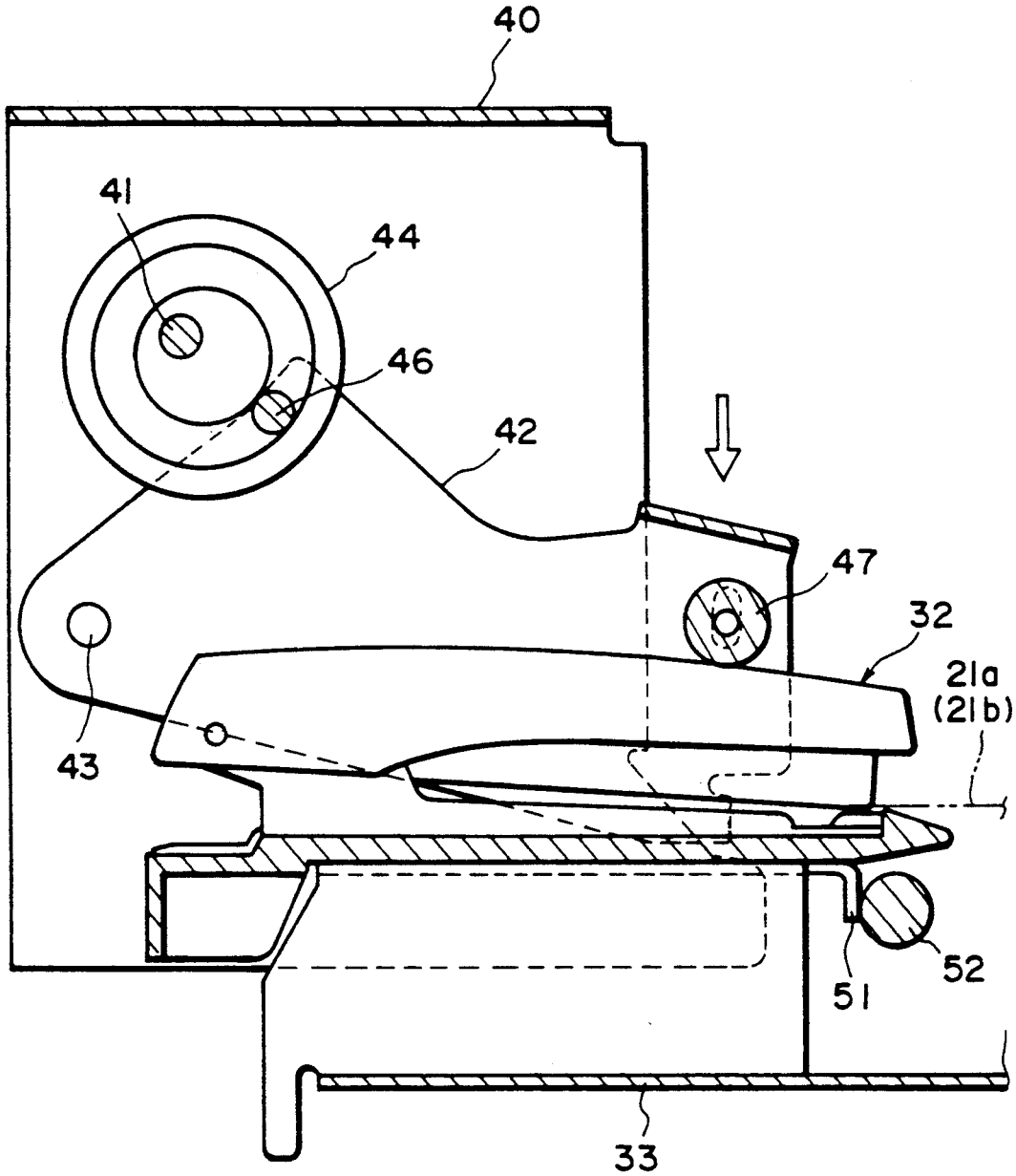
FIG. 9 is a side sectional view illustrating operation of the clinching mechanism.

The driving shaft 41 is rotated one-full turn to effect the clinching operation. First, in the moving mechanism 31, the rotatable cam 60 shown in FIG. 6 starts to rotate. About 60 degrees of the rotational position, the reciprocal movement of the swingable lever 61 is completed. By the reciprocal movement, the urging member 65 of the swingable lever 61 pushes the contacting lever 69 out. Therefore, as shown in FIG. 8, the slidable frame 33 is moved to the clinching position, and the tongue 51 of the mounting portion 34 of the swingable frame 33 is contacted to the stopper 52, by which the position thereof is limited (FIG. 9).

By this movement of the slidable frame 33, the clinching position A of the sheets 21*a* or 21*b* is introduced into the clinching position of the stapler 32.

This state is maintained from the initial stage of the rotation of the cam 60 to the angular position thereof of about 300 degrees.

In the clinching mechanism, the eccentric rotatable cam 44 starts to rotate from the position shown in FIG. 5 to lower the clinching lever 42. At the cam 44 angular position of about 70 degrees, the clinching roller 47 is contacted to the top surface of the stapler 32. With further rotation, the forward (downward) movement of the clinching lever 42 is completed by approximately 180 degrees rotation from the start of the rotation. By the forward movement, the clinching roller 47 presses the stapler 32 at its top part. As shown in FIG. 9, the sheets 21*a* or 21*b* disposed at the clinching position A are stapled.

With further rotation of the rotating cam 44, the clinching lever 42 moves upwardly, by which the stapler is released. At about 290 degrees position from the start of the rotation, the clinching roller 47 is disengaged from the top surface of the stapler 32. Upon completion of one-full turn, it is returned to the retracted position shown in FIG. 5.

At the position of about 30 degrees from the start of the rotation of the cam 60 in the moving mechanism 31, the backward movement of the swingable lever 61 is permitted. Upon completion of one-full rotation, it is returned to the retracted position shown in FIG. 6.

The description will be made as to the loading operation for the stapler 32.

As shown in FIG. 7, when the operating portion 81 of the releasing lever 76 is depressed, the contact portion 78 thereof raises the releasing roller 75 of the contacting lever 69, and therefore, the roller 72 at the rear side of the contacting lever 69 is disengaged from the urging member 65 of the swingable lever 61.

Figure 10:
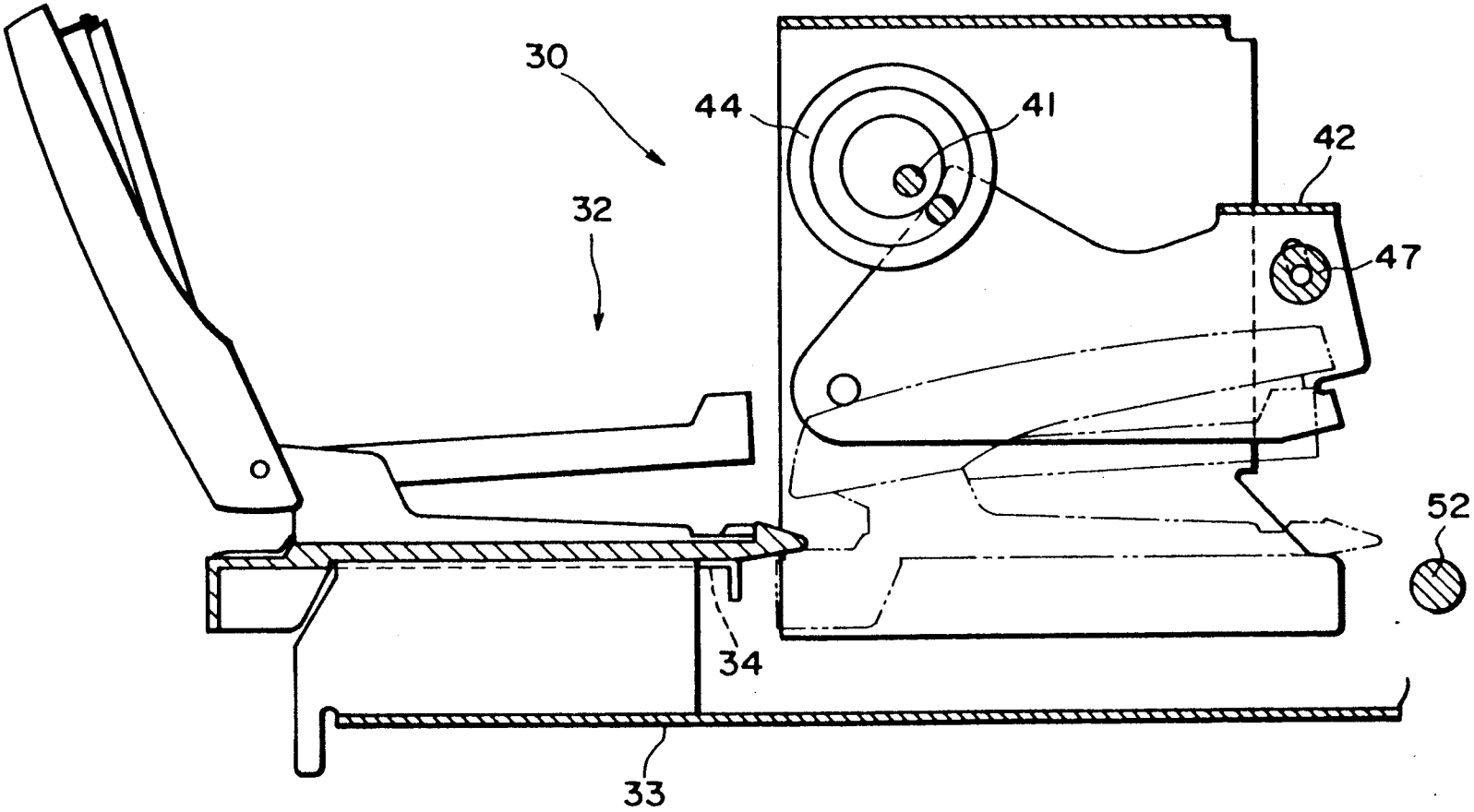
FIG. 10 is a side sectional view illustrating operation for loading the stapler.

As a result, the slidable frame 33 is permitted to move from the retracted position to the loading position by the spring 39. As shown in FIG. 10, the stapler 32 is drawn out. Then, the upper part is opened, so that the staples can be loaded.

After the stapler is loaded with the staples, the slidable frame 33 is manually urged toward the inside of the apparatus. Then, the roller 72 of the contacting lever 69 is lowered by the inclined guiding surface 82 of the pressing part 65 of the swingable lever 61. It is then locked at the front side of the pressing portion 65, so that it can be restored to the retracted position.

According to the automatic stapler 20 of this embodiment described in the foregoing, the stapler 32 is mounted on the mounting portion 34 of the slidable frame 33. The stapler 32 is the one readily available in the market as office equipment. Therefore, the cost is very low. When the stapler 32 is damaged, the stapler 32 may be replaced with new one, and therefore, the maintenance is easy.

The rotatable cams 44 and 60 are driven by a one driving shaft 41 to move the slidable frame 33 and the clinching lever 42, and therefore, the structure is simplified, and the height of the structure is reduced, thus minimizing the size of the device.

While the invention has been described with reference to the structures disclosed herein, it is not confined to the details set forth and this application is intended to cover such modifications or changes as may come within the purposes of the improvements or the scope of the following claims

What is claimed is:

1. An image forming apparatus, comprising:

image forming means for forming image on sheets;

supporting means for supporting a stack of the sheets on which the images have been formed by said image forming means;

stapling means for stapling the stack of the sheets on said supporting means;

moving means at an operating position for moving said stapling means between a first position for stapling the sheet by said stapling means and a second position for not stapling the sheet;

guide means for guiding said stapling means from said first position to a third position different from the first position while maintaining said moving means at the operating position of said moving means.

2. A sheet finisher apparatus, comprising:

supporting means for supporting a stack of sheets;

stapling means for stapling the stack of the sheets on said supporting means;

moving means at an operating position for moving said stapling means between a first position for stapling the sheet by said stapling means and a second position for not stapling the sheet; and guide means for guiding said stapling means from said second position to a third position different from the first position while maintaining said moving means at the operating position of said moving means.

3. An image forming apparatus, comprising:

image forming means for forming images on sheets;

supporting means for supporting a stack of sheets, on which the images have been formed by said image forming means;

stapling means for stapling the stack of the sheets on said supporting means at a clinching position;

moving means for moving said stapling means between the clinching position and a waiting position; and guide means for guiding said stapling means between the clinching position and an outside position of said sheet finisher apparatus, wherein said guide means guides said stapling means to the outside position of said apparatus while maintaining said moving means inside of said apparatus.

4. A sheet finisher apparatus, comprising:

supporting means for supporting a stack of sheets;

a stapler for stapling the stack of the sheets;

a moving means for moving said stapler between a clinching position for stapling the sheets on said supporting means by said stapler and a retracted position away from the clinching position;

a clinching means for effecting the stapling action of said stapler at the clinging position; and driving transmitting means for effecting, by a single driving source, movement of said stapler by said moving means and a stapling action by said clinching means.

5. An apparatus according to claim 4, wherein said moving means includes a swingable lever which is swingable by the driving source, wherein said stapler is moved between the clinching position and the retracted position by swinging movement of the swingable lever.

6. An apparatus according to claim 4, wherein said clinching means includes a clinching lever which is swingable by the driving source, wherein said stapler is urged in a clinching direction to effect the clinching operation by swinging movement of the clinching lever.

7. An apparatus according to claim 4, wherein said driving source produces rotational driving force.

8. An apparatus according to claim 7, wherein said moving means includes a swingable lever for moving said stapler between the clinching position and the retracted position, wherein said clinching means includes a clinching lever for urging said stapler in a clinching direction by a swinging movement of the swingable lever, and wherein said drive transmitting means includes a driving shaft for transmitting the rotational driving force from the driving source, a first cam connected with the driving shaft to swing the swingable lever and a second cam connected with the driving shaft to swing the clinching lever.

9. An apparatus according to claim 8, wherein the first cam swings the swingable lever to move the stapler to the clinching position ,and after the movement of the stapler, the second cam swings the clinching lever to effect the clinching operation.

10. An apparatus according to claim 4, wherein said supporting means is provided with aligning means for aligning the sheets thereon prior to the clinching operation of said stapler.

11. An apparatus according to claim 10, wherein the aligning means is provided with a reference stopper adjacent the clinching position and an urging bar for abutting the sheets to the reference stopper.

12. An apparatus according to claim 4, wherein the supporting means includes plural trays for supporting stacks of the sheets and tray moving means for moving the trays supporting the sheets to be stapled to the clinching position.

13. An apparatus according to claim 12, wherein the supporting means is provided with aligning means for aligning the sheets on the trays.

14. An apparatus according to claim 15, wherein the aligning means includes a reference stopper for each of the trays adjacent the clinching position, and an urging bar penetrated through the trays to urge the sheet to the respective reference stoppers.

15. An apparatus according to claim 4, wherein said stapler is detachably mountable on said moving means.

16. A sheet finisher apparatus, comprising:

supporting means for supporting a stack of sheets;

a stapler for clinching the sheets on said supporting means;

a moving means for linearly reciprocating said stapler between a clinching position for stapling the sheets and a retracted position away from the clinching position;

a clinching means movable in a direction crossing with a direction of the reciprocal movement of said moving means to effect a clinching operation of said stapler at the clinching position; and drive transmitting means for effecting, by a single driving source, the reciprocal movement of said moving means and movement of said clinching means.

17. An apparatus according to claim 16, wherein said moving means includes a frame for supporting said stapler, said frame being movable along a rectilinear line including the clinching position and the retracted position, a swingable lever swingable by the driving source to reciprocate the frame, wherein said clinching means includes a clinching lever for substantially vertically swinging by the driving source to effect the clinching operation of said stapler, and wherein said drive transmitting means includes a driving shaft for transmitting rotational driving force from the driving source, a first cam connected with said driving shaft for swinging the swingable lever, and a second cam connected with the driving shaft for swinging the clinching lever.

18. An apparatus according to claim 17, wherein the first cam swings the swingable lever to move the stapler to the clinching position, and after the movement of the stapler, the second cam swings the clinching lever to effect the clinching operation.

19. An apparatus according to claim 16, wherein said moving means is retractable outwardly away from the retracted position in a direction away from the clinching position to an outside position where said stapler is detachable.

20. An apparatus according to claim 19, wherein said moving means includes locking means for disabling movement to the outside position, and releasing means for releasing said locking means.

21. An apparatus according to claim 20, wherein said releasing means is manually operable.

22. A sheet finisher apparatus, comprising:

supporting means for supporting a stack of sheets;

stapling means for stapling the sheets on said supporting means;

clinching means for automatically operating said stapling means at a clinching position inside of said sheet finisher apparatus; and guide means for guiding said stapling means between the clinching position and an outside position outside of said sheet finisher apparatus, wherein said guide means guides said stapling means to the outside position while maintaining said clinching means at said clinching position.

23. An apparatus according to claim 22, wherein at the outside position of said mounting means, said stapler is loadable with staples.

24. An apparatus according to claim 23, further comprising locking means for disabling retraction of said guide means and a releasing means for releasing the locking means.

25. An apparatus according to claim 24, wherein said releasing means is manually operable.

26. An apparatus according to claim 22, wherein the supporting means includes plural trays for supporting stacks of the sheets and tray moving means for moving the trays supporting the sheets to be stapled to the clinching position.

27. An image forming apparatus, comprising:

imaging forming means for forming images on sheets;

supporting means for supporting a stack of the sheets on which the images have been formed by said image forming means;

a sheet finisher apparatus including supporting means for supporting a stack of sheets; a stapler; a moving means for moving said stapler between a clinching position for clinching the sheets on said supporting means by said stapler and a retracted position away form the clinching position; a clinching means for effecting the stapling action of said stapler at the clinching position; and drive transmitting means for effecting by one driving source movement of said stapler by said moving means and the stapling action by said clinching means.

28. An apparatus according to claim 27, wherein said supporting means comprises a sorter having plural trays, each of which supports a stack of sheets having images formed by said image forming means.

29. An image forming apparatus, comprising:

imaging forming means for forming images on sheets;

supporting means for supporting a stack of the sheets on which the images have been formed by said image forming means;

stapling means for stapling the stack of sheets on said supporting means;

clinching means for automatically operating said stapling means at a clinching position inside of said apparatus; and guide means for guiding said stapling means between the clinching position and an outside position outside of said image forming apparatus, wherein said guide means guides said stapling means to the outside position while maintaining said clinching means at said clinching position.

30. An apparatus according to claim 29, wherein when said mounting member is retracted, said stapler is detachable.

31. A sheet finisher apparatus comprising:

supporting means having a plurality of substantially vertically movable trays each for supporting a stack of sheets;

stapling means for stapling each of said stack of sheets on the trays at a clinching position;

moving means for moving, in accordance with movement of said trays, said stapling means between the clinching position and a waiting position without interfering with the movement of said trays; and guide means for guiding said stapling means between the clinching position and an outside position outside of said sheet finisher apparatus, wherein said guide means guides said stapling means to the outside position while maintaining said moving means inside said apparatus.

32. An apparatus according to claim 31, wherein said stapling means is manually operable when it is detached from said mounting means.

33. An image forming apparatus, comprising:

imaging forming means for forming images on sheets;

supporting means having a plurality of substantially vertically movable trays each for supporting a stack of sheets having images formed thereon by said image forming means;

stapling means for stapling the stacks of sheets on the trays at a clinching position; and moving means for moving, in accordance with movement of said trays, said stapling means between the clinching position and a waiting position without interfering with the movement of said trays; and guide means for guiding said stapling means between the clinching position and an outside position outside of said image forming apparatus.

wherein said guide means guides said stapling means to the outside position while maintaining said moving means inside said apparatus.

34. A sheet finisher apparatus, comprising:

supporting means for supporting a stack of sheets;

stapling means for stapling the stack of the sheets on said supporting means at a clinching position;

moving means for moving said stapling means between the clinching position and a waiting position; and guide means for guiding said stapling means between the clinching position and an outside position outside of said sheet finisher apparatus;

wherein said guide means guides said stapling means to the outside position of said apparatus while maintaining said moving means inside said apparatus.

35. A sheet finisher apparatus, comprising:

supporting means for supporting a stack of sheets;

stapling means for stapling the stack of the sheets;

guide means for guiding said stapler between a first position for stapling the sheets on said supporting means by said stapler and a second position away from said first position; and clinching means for effecting the stapling action of said stapler at said first position;

wherein said guide means guides said stapler to the second position, leaving said clinching means at the first position.

* * * * *

UNITED STATES PATENT AND TRADEMARK OFFICE

CERTIFICATE OF CORRECTION

PATENT NO. : 5,279,494

DATED : January 18, 1994

INVENTOR(S) : TADAYUKI KITAJIMA, ET AL.

It is certified that error appears in the above-indentified patent and that said Letters Patent is hereby corrected as shown below:

On the Title Page,
Item [56], "2-97493 12/1990 Japan" should read --2-297493 12/1990 Japan--.

Column 2,
Line 32, "a" should be deleted.

Column 8,
Line 27, "image" second occurence should read --images--.

Column 9,
Line 11, "clinging" should read --clinching--; and
Line 61, "claim 15," should read --claim 13,--.

Column 10,
Line 61, "stapler" should read --stapling means--.

UNITED STATES PATENT AND TRADEMARK OFFICE

CERTIFICATE OF CORRECTION

PATENT NO. : 5,279,494

DATED : January 18, 1994

INVENTOR(S) : TADAYUKI KITAJIMA, ET AL.

It is certified that error appears in the above-indentified patent and that said Letters Patent is hereby corrected as shown below:

Column 11,
Line 17, "form" should read --from--.

Column 12,
Line 13, "imaging" should read --image--; and
Line 46, "stapling means" should read --a stapler--.

Signed and Sealed this

Second Day of August, 1994

Bruce Lehman

*Attest:*

BRUCE LEHMAN

*Attesting Officer*

*Commissioner of Patents and Trademarks*